US005456575A

United States Patent [19]

Helmer et al.

[11] Patent Number: 5,456,575

[45] Date of Patent: Oct. 10, 1995

[54] NON-CENTRIC IMPROVED PUMPING STAGE FOR TURBOMOLECULAR PUMPS

[75] Inventors: John C. Helmer, Menlo Park, Calif.; Giampaolo Levi, Turin, Italy

[73] Assignee: Varian Associates, Inc., Palo Alto, Calif.

[21] Appl. No.: 242,937

[22] Filed: May 16, 1994

[51] Int. Cl.[6] ..... F04D 5/00

[52] U.S. Cl. ..... 415/55.1; 415/90

[58] Field of Search ..... 415/55.1, 55.2, 415/55.3, 55.4, 55.5, 90

[56] References Cited

U.S. PATENT DOCUMENTS

| | | | |
|---|---|---|---|
| 3,402,669 | 9/1968 | Mamo | 415/55.1 |
| 4,573,882 | 3/1986 | Watanabe et al. | 415/55.1 |
| 4,591,311 | 5/1986 | Matsuda et al. | 415/55.5 |
| 5,238,362 | 8/1993 | Casaro et al. | 415/90 |

FOREIGN PATENT DOCUMENTS

| | | | |
|---|---|---|---|
| 94095 | 4/1988 | Japan | 415/55.4 |

*Primary Examiner*—John T. Kwon

*Attorney, Agent, or Firm*—Bella Fishman; David J. Power

[57] ABSTRACT

The present invention refers to a pumping stage particularly designed for turbomolecular pumps, having increased compression ratio, and capable of extending the operating range of the turbomolecular pump towards high pressure. The new pumping stage comprises a casing housing, a rotor disk, and a substantially coplanar stator ring. The stator ring consists of two plates connected with each other along their circumferential periphery, thereby defining a region of close tolerance with the opposite surfaces of the rotor. The rotor and stator cooperate to define a tapered, free annular channel having a suction port and a discharge port at the opposite ends of this channel. The channel tapers in a functional, predetermined fashion, having the largest cross-sectional area near the suction port, and converging, according to the rotational direction of the rotor, at the discharge port.

11 Claims, 4 Drawing Sheets

NON-CENTRIC IMPROVED PUMPING STAGE FOR TURBOMOLECULAR PUMPS

FIELD OF THE INVENTION

The present invention relates to a pumping stage of unique geometry especially designed for turbomolecular pumps. In particular, it relates to a pumping stage designed to have an increased compression ratio and an operating range extended to higher pressures than previously known.

BACKGROUND OF THE INVENTION

Pumping stages utilized in turbomolecular pumps to create high vacuum conditions are previously known to exist in many different designs, some of which incorporate a stator housing having a rotor disk embodied therein, wherein a gas passageway is defined along a tangential channel established between the rotor and stator.

Pumping stages especially designed for increasing pump operating range in terms of discharge pressure are discussed in German Patent No. 3,819,529, as well as European Patent Application No. 0,445,815, the latter being in the name of the applicant.

German Patent No. 3,819,529 discloses a vacuum pump having a rotor disk with a recessed periphery, forming radially extending steps which operate in conjunction with a stator having an annular groove for receiving the recessed periphery of the rotor disk. The juxtaposed rotor and stator form flow passages between the surfaces of the annular groove and the corresponding steps positioned on the periphery of the rotor disk. A disadvantage of this type of construction is that it provides a channel that is divided on the opposite faces of the rotor disk; thereby forcing the gas to follow a tortuous path when entering the portion of the channel below the rotor disk via the suction port, or when leaving the portion of the channel above the rotor disk through the discharge port.

European Patent Application No. 0,445,855 discloses a turbomolecular pump which utilizes, in addition to conventional axial flow pumping stages, one or more tangential flow pumping stages. These tangential flow pumping stages are positioned at the exhaust side of the pump in order to raise the exhaust pressure up to atmospheric pressure; thereby allowing the pump to discharge at higher pressures without being combined with a forepump. The use of these tangential flow pumping stages are effective in either a molecular or transient flow pressure range, and permit the raising of the outlet pressure from about 1 Pa to over $10^3$ Pa. A further rise of the outlet pressure, up to atmospheric pressure, has been obtained utilizing a different rotor design incorporating peripheral vanes mounted normal to the peripheral edge.

It is therefore a feature of the present invention to provide a modified geometry for a pumping stage, of the type described above, to improve gas compression performances and to further extend the operating range of turbomolecular pumps incorporating said invention.

It is a further feature of the present invention to provide a pumping stage design which can be easily incorporated in a turbomolecular pump, either alone or in cooperation with one or more similar pumping stages, thereby allowing the turbomolecular pump to discharge to higher pressures, approaching atmospheric pressure, without being teamed up to a forepump.

It is still a further feature of the present invention to provide a pumping stage design which can be manufactured easily at a low cost, as well as being easy to use and simple to maintain.

SUMMARY OF THE INVENTION

The above mentioned features of the invention and the advantages they provide are achieved by the present invention by means of an improved tangential flow pumping stage, having a non-centric geometry, as a component in a turbomolecular pump. The improved pumping stage comprises a casing housing, consisting of two plates having respectively a suction and discharge port contained therein, and coupled along their respective peripheral edges, thereby defining a first region of close tolerance with the opposing plate surfaces of a rotor disk and stator ring contained therein. The rotor disk is arranged in a substantially coplanar relationship with the stator ring such that a tapered channel of converging close tolerance, in the direction of rotor rotation, is defined between the internal lateral surface of the stator ring, which is partially grooved, and the peripheral lateral surface of the rotor disk; wherein the discharge and suction ports are located at the opposed ends of the channel. A smooth portion of the internal lateral surface of the stator ring and the lateral surface of the rotor disk form a second region of close tolerance therebetween.

BRIEF DESCRIPTION OF THE DRAWINGS

The invention will now be described in greater detail with reference to the accompanying drawings, in which.

DETAILED DESCRIPTION OF THE INVENTION

Figure 1:
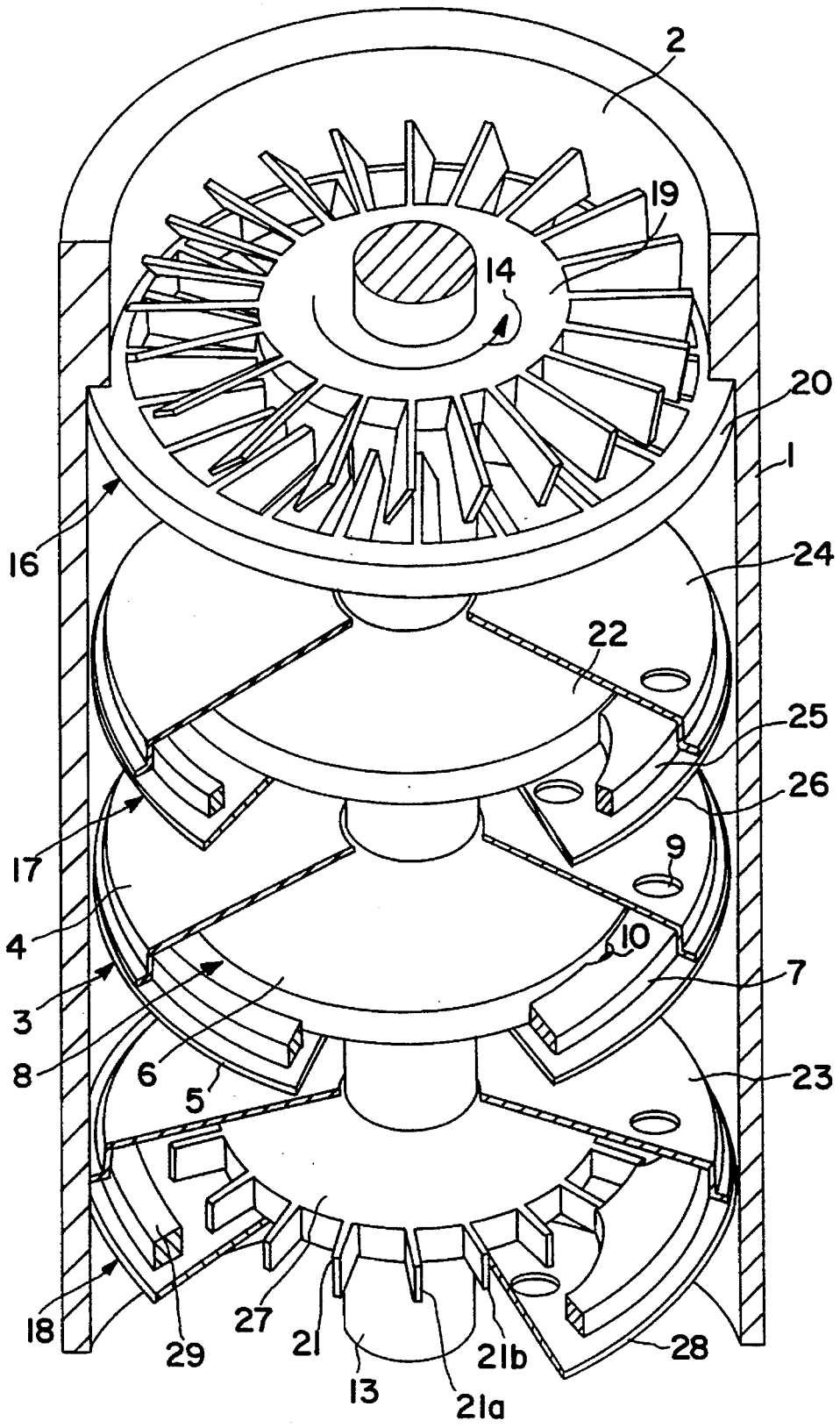
FIG. 1 is a perspective view of a section of a turbomolecular pump having a partially broken view of a first embodiment of the pumping stage of the present invention.

A first embodiment of the present invention will be hereinafter described with reference to FIGS. 1 to 3. In FIG. 1, turbomolecular pump housing 1 and exhaust passageway 2 is depicted, having a pumping stage 3 of the present invention. As shown, pumping stage 3 comprises an upper closure plate 4 and a lower closure plate 5, which house a rotor disk 6 in concentric alignment with a peripherally positioned stator ring 7, mounted in exhaust passageway 2. Stator ring 7 is spaced apart from rotor disk 6, so as to form a first region of close tolerance between the lateral surface of the peripheral edge of rotor disk 6 and the inner circumferential surface of stator ring 7.

Figure 2:
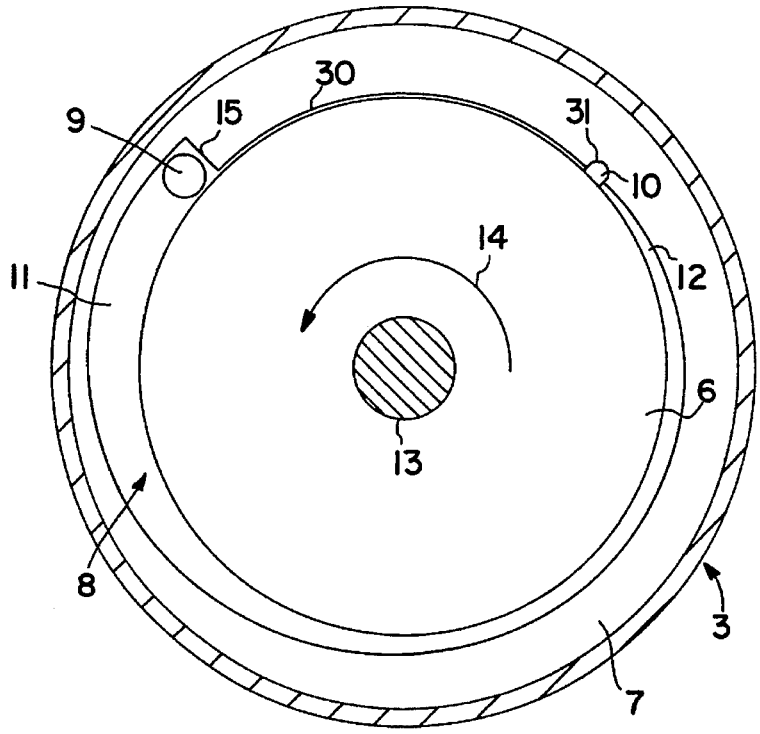
FIG. 2 is a plan view of the pumping stage of the present invention.
Figure 3:
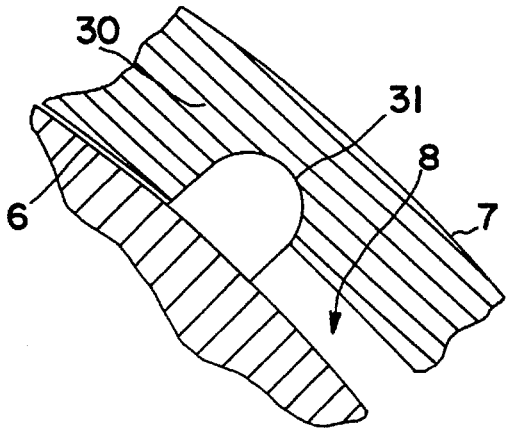
FIG. 3 is a schematic sectional view showing a discharge port of the pumping stage of the present invention.

As shown in FIG. 2, a linearly tapered groove in stator ring 7 establishes a channel 8. A suction port 9 and a discharge port 10 are positioned at the opposite ends of the channel, to define an inlet region 11 and a discharge region 12 within said channel respectively. The inlet area at the onset of channel 8, and corresponding to suction port 9, is formed substantially larger than the discharge area at the terminus of channel 8, corresponding to discharge port 10. Channel 8 is initiated at the peripheral edge of suction port 9, and convergingly tapers as it traverses along a circumferential direction around rotor disk 6, according to the rotational direction of rotor 14, such that the cross-sectional area of channel 8 is reduced at a predetermined rate as it approaches discharge region 12. The rate at which the channel tapers may be linear, as in the depicted embodiment, or exponential or sinusoidal, or other functional relation depending on the operational characteristics desired. Preferably suction port 9 and discharge port 10 are positioned within about 330 degrees from each other with respect to the circumference of the stator ring. The remaining 30 degrees of non-grooved area of the stator is shown in FIG. 2 to form a second area of close tolerance 30 between the rotor and the stator.

Step 15 is established at the onset of channel 8, adjacent to suction port 9, at the transition point between the grooved channel and region of close tolerance 30, of depth equal to the maximum depth of the groove in inlet region 11. Suction port 9 is designed to have a diameter smaller than the groove aperture in suction region 11, therefore the orifice of suction port 9, as well as the corresponding orifice in upper plate 4, is contained completely within the dimensions of channel 8. Discharge port 10, however, is designed to have a larger diameter than the aperture of channel 8 in discharge region 12, to allow the gas being pumped through said channel to discharge more rapidly. To facilitate the discharge of gas through discharge port 10, a radial groove 31, as better shown in FIG. 3, is incorporated in stator ring 7 at the terminus of channel 8. Preferably the ratio between the radius of channel 8, measured at suction pump 9, and the radius at the discharge port 10 is of 1/10.

Gaede-type pumps used in the past have employed channels of substantially uniform cross-section, resulting in the compression in such pumps dropping rapidly when the molecular mean free path between collisions becomes less than the radius of the channel, and the flow conditions change from molecular to viscous. While viscous compression in a uniform channel having a diameter 1 cm, for example, is very low, it has been found that by tapering the channel to form an aperture of small dimension at the discharge region of the channel, the compression ratio is substantially increased. In particular, it has been found, for example, that for a linear taper the compression ratio K in viscous flow is determined by the following equation:

$$K_0 = 1 + \frac{3V_s}{V_0} \cdot \frac{\Sigma_1 \cdot L}{a_1 \cdot a_2} \quad (1)$$

where $V_s$ is the average drag velocity of the gas;

V is the thermal molecular velocity;

$\Sigma_1$ is the molecular free path at the entrance of the channel;

$a_1$: is the radius of the entrance of tile channel;

$a_2$ is the radius of tile exit of the channel;

$a_2$ is the radius of the exit of the channel;

L is the length of the channel.

For the determination $\Sigma_1$, the molecular mean free path at a pressure P can be estimated from the following relationship:

$$\Sigma_1(\text{mm}) = \frac{666.5 \cdot 10^{-2}\ (\text{Pa mm})}{P(\text{Pa})}$$

Therefore, if we assume that 3 $V_2/V_0$=1 at a pressure of about 666.5 Pa, we obtain:

$$\Sigma_1 = \frac{(666.5)(10^{-2})(\text{Pa mm})}{666.5\ \text{Pa}} = 10^{-2}\ \text{mm}.$$

For a length of the channel of 200 mm, $a_1$:=1 mm and $a_2$=0.1 mm, we obtain $K_0$=21.

For a channel of uniform cross section, where $a_1$=$a_2$=1 mm, we obtain $K_0$=0.3.

In a condition of zero flow, i.e. at which compression is defined, the discharge pressure of the tapered channel is:

$$P=666\cdot 5\cdot 21=14\cdot 10^3\ \text{Pa}$$

In molecular flow conditions, as opposed to viscous flow, the compression ratio $K_0$ is given by the following equation:

$$K_0 = \exp \int_0^L 3\frac{V_s}{V_0} \cdot \frac{dx}{a(x)} \quad (2)$$

If we assume that 3 V/V=1, and a(x) functionally represents the taper dimension of the channel, for a channel of uniform cross section where a is a constant, e.g. a:=a=10 mm, we obtain:

$$K=\exp(L/a)$$

for a linear tapered channel, e.g. $a_1$=10 mm, $a_2$=1 mm, we obtain:

$$K_0 = \exp\left[\frac{L}{a_1 - a_2} \ln\left(\frac{a_1}{a_2}\right)\right] \quad (2)$$

The compression ratio K, therefore, in molecular flow conditions is higher for a tapered channel than for a linear channel.

It is to be noted that for channels which taper according to other than a linear relationship, such as an exponential or sinusoidal taper, that a(x) will reflect this relationship according to equation (2).

Figure 4:
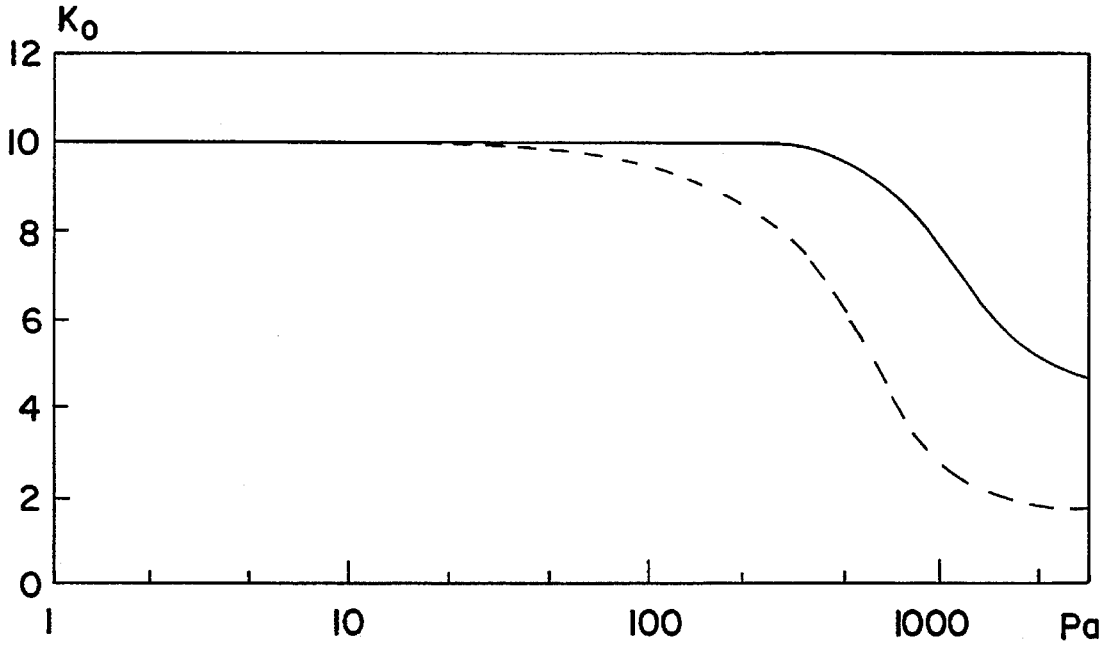
FIG. 4 is a graph showing the relation between compression ratio and discharge pressure of a pumping stage of the present invention.

Indicated by a solid line in FIG. 4 is tile relation between compression ratio $K_0$ and discharge pressure for a pumping stage with a tapered channel, as compared to the compression ratio for a common tangential pumping stage with uniform channel, indicated in FIG. 4 by a broken line. As is obvious from FIG. 4, the performance of the new pumping stage design is superior to that of the previous pumping stage particularly as pressure rises higher than 100 Pa, where as indicated by the broken line, K dramatically drops off as opposed to the performance of the present invention.

Figure 6:
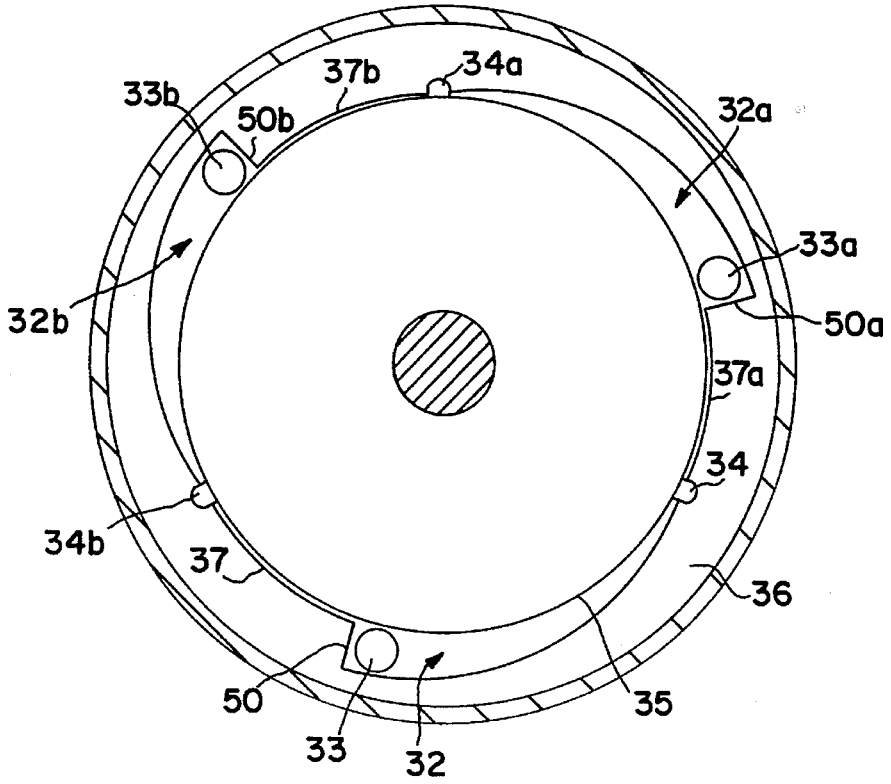
FIG. 6, in a view corresponding to FIG. 2, shows a second embodiment of the invention.

The high performances of the pumping stage of the present invention alternatively allows the use if a plurality of short channels, instead of a unique long channel, in the same pumping stage, as shown in FIG. 6. With this solution the pumping speed is increased as a function of the number of channels provided in each pumping stage, e.g. the pumping speed of a two channels pumping stage will be twice the speed of a single channel pumping stage.

FIG. 1 also shows the other known pumping stages configured in series with the pumping stage of the present invention to constitute an entire turbomolecular pumping system in an illustrative embodiment. In particular there is shown: an axial flow pumping stage 16, comprising a vane rotor 19 and vane stator 20, first tangential flow pumping stage 17 comprising rotor disk 22 positioned concentric with a stator consisting of two plates 24, 26, and ring 25, and a second tangential flow pumping stage 18 comprising rotor disk 27 equipped with vanes 21 and a stator consisting of two plates 23, 28 and ring 29.

In FIG. 6, as previously discussed, there is shown a first modified embodiment of the invention. In this embodiment the tapered channel is shortened, as opposed to the previous embodiment, so as to define a plurality of identically tapered channels 32, 32*a*, 32*b*, arranged between rotor disk 35 and stator ring 36, each provided of suction port 33, 33*a* and, 33*b* and discharge port 34, 34*a* and 34*b*. In this second embodiment, stator ring 36 is provided with a series of radial grooves of clockwise decreasing depth defining, with the lateral surface of rotor disk 35, a series of tapered channels 32, 32*a*and 32*b*, spaced apart by regions of close tolerance 37, 37*a* and 37*b* between the lateral surface of rotor 35 and stator ring 36. Steps 50, 50*a* and 50*b* are formed between the grooves and regions 37, 37*a* and 37*b*, the depth of said steps being equal to the maximum depth of the grooves where circular suction ports 33, 33*a* and 33*b* are located.

The most essential functional difference between this alternative embodiment over the embodiment of FIG. 2 is that for the same angular velocity of rotor 35, the pumping stage tapered design performances are better exploited and the pumping speed is increased. This means that the weight of the pump as well as the overall pump assembly complexity is reduced.

Still referring to FIG. 1, it is noted that several pumping stages can be housed in the same turbomolecular pump. In this multiple stage embodiment suction and discharge ports are placed so as to allow the gas axially flowing from one pumping stage to the other to follow a direct path. Therefore, the angular position of a discharge port of one pumping stage corresponds to the angular position of a suction port of the following pumping stage.

Figure 5:
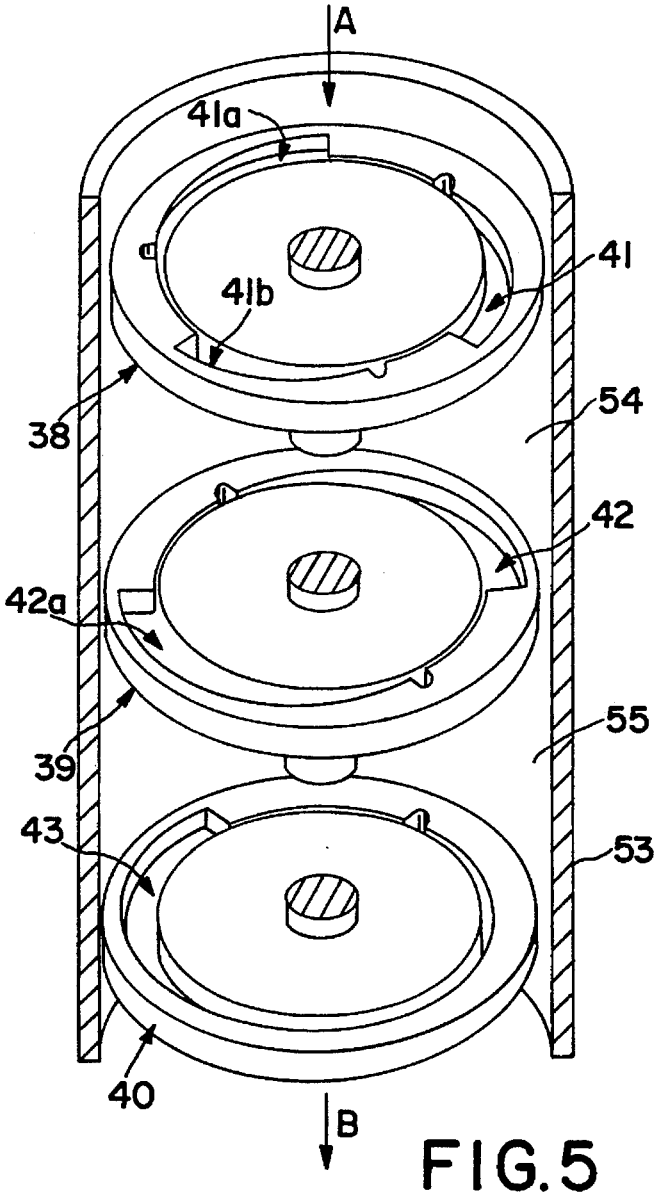
FIG. 5 is schematic perspective view of a section of the turbomolecular pump housing, wherein the pumping stages of the present invention are depicted in a preferred arrangement.

With reference to FIG. 5, it has been found particularly advantageous to provide a sequence of pumping stages as described above, wherein the number of channels in each successive pumping stage decreases from the pump inlet, indicated by arrow A where molecular flow conditions exist, towards the pump outlet indicated by arrow B where viscous flow conditions exist.

Still referring to FIG. 5, there is schematically shown a pump embodiment wherein three pumping stages 38, 39 and 40 are provided in a pump housing 53. Pumping stage 38 is shown as having three channels 41, 41*a* and 41*b*, with the second stage having two channels labeled as 42 and 42*a* and, the final stage having one channel 43, wherein each channel is formed according to the present invention. Pumping speed is therefore considerably improved, being thrice the standard speed of a pumping stage with one channel in case of three channels, and twice the standard speed of a pumping stage with one channel in case of two channels. According to this embodiment, pumping stages 38, 39 and 48 are arranged so as to define a small gap 54 and 55 between the successive stages to allow the gas coming from a discharge port of one stage to enter the suction ports of the following pumping stage. To avoid a pressure drop from occurring as the compressed gas passes from one successive stage to another, the volume within each successive stage accommodates a gas expansion and resulting pressure drop is decreased by reducing the number of channels in each successive stage. Different types of traditional pumping stages, as shown in FIG. 1, are further provided although not illustrated in FIG. 5.

Figure 7:
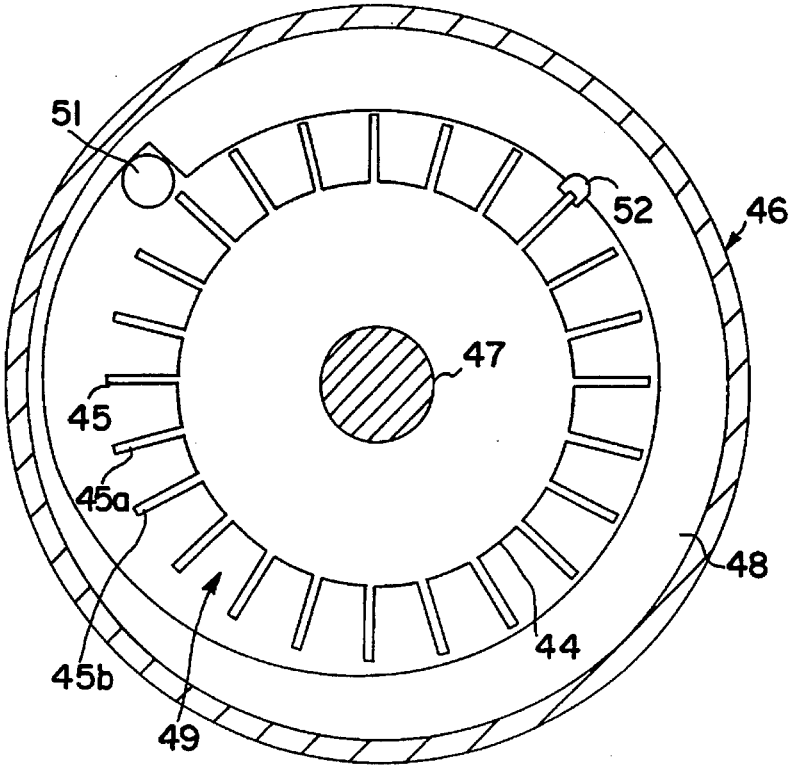
FIG. 7, in a view corresponding to FIG. 2, shows a third embodiment of the present invention.

In FIG. 7 there is shown an alternative third embodiment of the invention. In this embodiment rotor disk 44 is equipped with peripheral vanes such as 45, 45*a* and 45*b*, lying on planes perpendicular to the plane of disk 44. As already discovered during the tests carried out for the pump equipped with pumping stages according to European application No. B,445,855, at pressure ranges higher than $10^3$ Pa this different rotor design can produce a further rise of the outlet pressure, to the atmospheric pressure. With the tapered design of the channel, however, pressure values at the outlet are considerably increased over the previous embodiment.

Still referring to FIG. 7, pumping stage 46 comprises a shaft 47 extending axially in the pumping stage, and carrying a rotor disk 44 with peripheral vanes 45, 45*a* and 45*b*. Coplanar stator ring 48 encompasses rotor 44 but is spaced apart from said rotor, so that a free tapered channel 49 is defined between the radial periphery of said rotor 44 and stator ring 48. Channel 49 is further provided with suction port 51 and discharge port 52. Traditional rotors which consist of a monolithic set of parallel disks manufactured from a single block of alloy can still be used for the above-disclosed pumping stages, and the tapered channel of stator 49 can be easily obtained by forging. This further advantage of the invention in conjunction with the use of multiple channels only where required, as disclosed above, maintains the cost of production of these highly sophisticated turbomolecular pumps approximately equal to that of pumps with uniform channels.

While the invention has been described in conjunction with a few specific embodiments, it is evident to those skilled in the art that making alternatives, modifications and variations will be apparent in light of the foregoing description. Accordingly, the invention is intended to embrace all such alternative, modifications and variations as fall within the spirit and scope of the appending claims.

What is claimed is:

1. A turbomolecular pump having a tangential flow pumping stage, said tangential flow pumping stage comprising:

a casing housing, said casing housing comprising an opposing pair of connected plates, said plates having respective suction and discharge ports;

a rotor disk disposed within said casing housing, said rotor disk having a pair of opposed plane surfaces and a lateral surface, each said plane surface facing a respective plate of said casing housing and defining a first region of close tolerance therebetween;

a stator ring having a partially grooved inner surface disposed within said housing, said stator ring being substantially co-planar to said rotor, a smooth portion of said inner surface of said stator ring defining a second region of close tolerance with said lateral surface of said rotor disk; and said lateral surface of said rotor disk and said grooved inner surface of said stator ring cooperatively forming a channel therebetween, said channel having a pair of opposed ends, having said suction and discharge ports located at said opposed ends respectively, said channel convergingly tapered in a direction of rotation of said rotor disk from said suction port to said discharge port wherein said suction port is dimensioned to be disposed completely within said tapered channel.

2. The turbomolecular pump of claim 1 wherein said taper of said channel is linear.

3. The turbomolecular pump of claim 1 wherein the taper of said channel is exponential.

4. The turbomolecular pump of claim 1 wherein the taper said channel is sinusoidal.

5. The turbomolecular pump of claim 1 wherein said tapered channel further comprises a radial wall forming a step in proximity to said suction port.

6. The turbomolecular pump of claim 5, wherein said discharge port is to have a first portion disposed within said converged portion of said tapered channel and a second portion disposed within said inner stator ring surface.

7. The turbomolecular pump of claim 6 wherein said discharge port and said suction port, as projected on the stator ring plane is preferably positioned 330 degrees azimuthally apart along a periphery surface of said stator ring.

8. The turbomolecular pump of claim 7 wherein said rotor disk further comprising peripheral vanes positioned perpendicular to said lateral rotor plane surfaces.

9. The turbomolecular pump of claim 8 further comprising a plurality of pumping stages each said pumping stage having a tapered channel.

10. The turbomolecular pump of claim 9 wherein each pair of flow from each discharge port to each neighboring suction port.

11. The turbomolecular pump of claim 10 further comprising a plurality of pumping stages, each said pumping stage having a plurality of said tapered channels, wherein the number of said tapered channels decreases from an inlet towards an outlet of said pump.

* * * * *